US005681036A

United States Patent [19]

Wakahara et al.

[11] Patent Number: 5,681,036

[45] Date of Patent: Oct. 28, 1997

[54] SHEET FEEDING DEVICE WITH CONTROL OF SKEW-CORRECTION

[75] Inventors: Shinichiro Wakahara, Tokyo; Yasumi Yoshida; Kazuo Shishido, both of Yokohama, all of Japan

[73] Assignee: Canon Kabushiki Kaisha, Tokyo, Japan

[21] Appl. No.: 539,263

[22] Filed: Oct. 4, 1995

[30] Foreign Application Priority Data

Oct. 7, 1994 [JP] Japan ..... 6-243758
Nov. 30, 1994 [JP] Japan ..... 6-297363

[51] Int. Cl.[6] ..... B65H 5/00

[52] U.S. Cl. ..... 271/10.12; 271/227; 271/119; 271/228; 271/240; 271/238; 271/242; 271/245; 271/171

[58] Field of Search ..... 271/227, 228, 271/236, 238, 240, 242, 245, 246, 247, 171, 10.12, 119

[56] References Cited

U.S. PATENT DOCUMENTS 4,958,199 9/1990 Yamashita et al. ..... 271/245
5,156,391 10/1992 Roller ..... 271/227
5,169,140 12/1992 Werthe ..... 271/227
5,172,907 12/1992 Kalisiak ..... 271/227
5,486,910 1/1996 Harada ..... 271/246
5,516,093 5/1996 Ballard et al. ..... 271/240
5,533,721 7/1996 Takashimizu ..... 271/227

FOREIGN PATENT DOCUMENTS 406048616 2/1994 Japan ..... 271/240

*Primary Examiner*—H. Grant Skaggs
*Attorney, Agent, or Firm*—Fitzpatrick, Cella, Harper & Scinto

[57] ABSTRACT

A sheet feeding device can perform registration of a sheet with high precision even if the sheet is fed at high speed. The device includes a pair of active registration rollers, disposed at a side upstream from a reading unit in the sheet feeding direction, for correcting skew of the sheet, skew-amount detection sensors, disposed at a side downstream from the pair of active registration rollers in the sheet feeding direction, respective pairs of feeding rollers, disposed at a side upstream from the pairs of active registration rollers in the sheet feeding direction, and sheet detection sensors, disposed at a side upstream from the pairs of feeding rollers in the sheet feeding direction. Each of the pairs of feeding rollers includes a roller having a semispherical cross section at the driving side. When the leading edge of the sheet has been detected by the sheet detection sensors, the semispherical rollers are stopped in a state of not holding the sheet when the sheet is fed to the pair of active registration rollers by rotating the semispherical rollers by a predetermined number of revolutions at the same phase.

28 Claims, 10 Drawing Sheets

SHEET FEEDING DEVICE WITH CONTROL OF SKEW-CORRECTION

BACKGROUND OF THE INVENTION

1. Field of the Invention

This invention relates to a sheet processing device, such as a sheet feeding device, mounted in an image forming apparatus, such as a copier, a facsimile apparatus or the like. More particularly, the invention relates to a sheet feeding device for feeding a sheet to an image input or output unit while registering the sheet.

In this specification, a device having the function of feeding a sheet (an original) on which an image is formed or a sheet (paper or the like) for forming an image thereon to a processing unit, and discharging the sheet to the outside after predetermined processing (for example, image reading processing, transfer of a toner image, fixing processing and the like) has been completed by the processing unit is termed a sheet processing device.

2. Description of the Related Art

In a conventional apparatus for forming an image or reading an image, such as a copier, a scanner, a printer or the like, a registration device for adjusting the posture and the position of a sheet is used immediately before use of an image forming unit or an image reading unit of the apparatus. Such a registration device adopts, for example, (a) a loop registration method in which a sheet is bent by pressing the leading edge of the sheet against a nip between a pair of rollers which are stopped, wherein skew of the sheet is corrected by the stiffness of the sheet, or (b) a shutter registration method in which a shutter member for stopping the leading edge of a sheet is retractably provided in a sheet feeding path, wherein skew of the sheet is corrected by retracting the shutter member from the sheet feeding path after pressing the leading edge of the sheet against the shutter member.

Recently, however, as the number of digital image forming apparatuses and image reading apparatuses has increased, it has been intended to substantially increase the speed of image formation without increasing the process speed of image formation by reducing the interval between adjacent sheets (hereinafter termed an "intersheet interval"), so as to process many sheets within a short time period.

For example, in a conventional analog copier, when performing a continuous copying operation, since an optical device for exposing an original must reciprocate for a number of times equal to the number of copies, the intersheet interval for copying information from the original is inevitably determined. However, when digitally reading an original and forming the image of the original, the image information is electrically encoded and stored in a memory after first reading the original. When forming the image, the image information stored in the memory is read, and an image corresponding to the image information is formed on a photosensitive member of an image forming unit by an exposure device, such as laser light, an LED (light-emitting diode) array or the like. Accordingly, the mechanical movement of the optical device becomes unnecessary even when forming a plurality of copies.

Accordingly, the period required for the above-described registration of a sheet is one of the great factors for determining the intersheet interval. An active registration method for correcting skew of a sheet while feeding the sheet is one of the methods which is proposed in order to shorten the registration time period. In this method, two sensors are disposed in a sheet feeding path on an axis orthogonal to the sheet feeding direction. Inclination of the leading edge of a sheet is detected based on signals obtained when the leading edge of the sheet crosses the respective sensors. Skew of the sheet is corrected by controlling the sheet feeding speed of skew correction rollers (hereinafter termed "registration rollers") disposed on an axis orthogonal to the sheet feeding direction and driven independently of each other. According to this method, skew correction can be performed while conveying a sheet without first stopping it. Hence, the intersheet interval can be smaller than in other methods.

For example, as shown in FIG. 5, sheets S are forwarded by a pickup roller 51, and are individually separated by a sheet separation/feeding unit 52. A separated sheet S is fed to a pair of active registration rollers 55 by respective pairs of feeding rollers 53 and 54. The amount of skew of the sheet S is then measured by sensors 56, and the skew is corrected by the pair of registration rollers 55 while the sheet S is fed to a reading unit 57.

In order to effectively utilize the pair of registration rollers 55, it is desirable that only the pair of registration rollers 55 support the sheet S. That is because, as shown in FIG. 6(*a*), even if a difference in revolution speed is produced for skew correction between left and right pairs of active registration rollers 55*a* and 55*b* in a state in which the sheet S is held by the pairs of feeding rollers 53 and 54, it is difficult to move the sheet S in the direction of an arrow A or an arrow B for such skew correction.

Hence, as shown in FIG. 6(*b*), by separating (in arrow direction C) the pair of feeding rollers 54 holding the sheet S therefrom using a solenoid 58 or the like, and producing a difference in the revolution speed between left and right pairs of active registration rollers 55*a* and 55*b* in a state in which the sheet S is held only by the pair of active registration rollers 55 (comprising roller pairs 55*a* and 55*b*), the skew can be corrected by easily moving the sheet S in the direction of the arrow A or the arrow B.

In the above-described conventional approach, an electric component, such as the solenoid 58 or the like, is used in order to separate the pair of feeding rollers 54 (which are disposed at a side upstream from the pair of active registration rollers 55), so as to effectively utilize the pair of active registration rollers 55. However, as the sheet feeding speed increases and the intersheet interval decreases, the sheet S is fed to the reading unit 57 before the pair of feeding rollers 54 are separated from the sheet S, due to a delay in the response of the electric component, even if it is intended to separate the pair of feeding rollers 54 after the sensors 56 have detected that the sheet S was held by the pair of registration rollers 55. Hence, it is difficult to effectively utilize the pair of active registration rollers 55.

In addition, it is necessary to contact the pair of feeding rollers 54 to each other after separating them, in order to prepare for the next sheet feeding. If the pair of feeding rollers 54 are made to contact with each other during an image reading operation, the read image tends to produce blurring due to the shock of the contact. Hence, it is desirable to contact the pair of feeding rollers 54 to each other in the intersheet interval. However, in the case of a short intersheet interval, the contact of the pair of feeding rollers 54 is influenced by a delay in the response of the electric component.

A sheet processing device in which a sheet is fed from a sheet mount (feeding tray) to a processing unit using center feeding reference includes left-side and right-side regulating members for regulating the position of the sheet in a lateral direction (the position in a direction orthogonal to the feeding direction) on the sheet mount. The left-side and right-side regulating members are set in advance by the operator to positions corresponding to the size of the sheet. At that time, when one of the left-side and right-side regulating members is moved in a lateral direction, the other member is also moved in the opposite direction by the same distance due to a interlocking mechanism.

Accordingly, the sheet mounted on the sheet mount is fed in a state of being regulated by the left-side and right-side regulating members. Since conventional side regulating members are operated only by the operator's hand, the members do not move from the set positions unless the operator changes the set positions.

The sheet processing device also includes skew correction means at a side upstream from the processing unit so that the sheet is processed at a correct posture (in a state in which skew is not present) by the processing unit. For example, an image reading device includes skew correction means at a side upstream from an image reading unit so that image reading can be performed from an original having a correct posture. An image forming apparatus, such as a printer, a facsimile apparatus, a copier or the like, includes skew correction means at a side upstream from an image forming unit so that image formation can be performed on a sheet having a correct posture.

Skew correction means for correcting a skewed state of a fed sheet adopts, for example, (1) a loop registration method using a pair of registration rollers which stop their rotation, (2) a shutter registration method using a registration shutter which is protrudable in a sheet feeding path, or (3) an active registration method using a pair of left and right registration rollers which rotate.

In the loop registration method, a skewed state of a sheet is corrected by forming a predetermined loop on the sheet, by pressing the leading edge of the sheet against a nip between a pair of registration rollers which stop their rotation, and by pressing the entire leading edge of the sheet against the nip by the sheet's restoring force produced by the loop.

In the shutter registration method, a skewed state of a sheet is corrected by pressing the entire leading edge of the sheet against a registration shutter by stopping the movement of the leading edge of the sheet being fed protruding the registration shutter in the sheet conveying path.

In the active registration method, a skewed state of a sheet is corrected by changing the feeding speed of one of pairs of left and right registration rollers. In the active registration method, since skew correction can be performed while feeding a sheet, it is possible to reduce the inter-sheet interval determining the throughput (the number of sheets which can be processed during a unit time period), and therefore to provide a high-speed processing apparatus.

In the above-described conventional sheet processing device, however, a skewed state of a sheet cannot be corrected with high accuracy if a sheet having a long size in the feeding direction is used.

That is, since the trailing edge of a sheet having a long size in the feeding direction remains on the sheet mount while skew correction is performed by the skew correction means, and the sheet is regulated by the left-side and right-side regulation members, the sheet cannot be subjected to skew correction. Particularly, when skew correction is performed by the skew correction means of the active registration method, since the movement of a sheet rotating around a nip between one pair of registration rollers is prohibited by the left-side and right-side regulating members, slip is produced in another pair of registration rollers for feeding the sheet by changing the feeding speed.

SUMMARY OF THE INVENTION

It is an object of the present invention to provide a sheet feeding device capable of solving the above-described problems and performing registration with high accuracy even if a sheet is fed at a high speed.

It is another object of the present invention to provide a sheet processing device capable of performing skew correction of a sheet having a long size in the feeding direction with high accuracy.

According to one aspect, the present invention, which achieves these objectives, relates to a sheet feeding device comprising skew correction means for correcting skew of a sheet, at least one roller, disposed at a side upstream from the skew correction means so as to be adjacent thereto, and having a noncontact portion, which does not contact the sheet, at its circumferential surface, for feeding the sheet to the skew correction means, and control means for controlling the roller so that the noncontact portion of the roller faces the sheet while the skew correction means corrects the skew.

According to another aspect, the present invention relates to a sheet feeding device comprising mounting means for mounting sheets, regulating means for regulating the positions of the sheets mounted on the mounting means in a lateral direction of the sheet (the lateral direction being orthogonal to a sheet feeding direction), feeding means for feeding one of the sheets from the mounting means, skew correction means for correcting skew of the sheet fed by the feeding means, and moving means for moving the regulating means so as to separate the regulating means from the sheet while the skew correction means corrects the skew of the sheet.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 3(*b*) is a perspective view illustrating the configuration of left-side and right-side regulating members provided on a sheet feeding tray of the image reading device;

DETAILED DESCRIPTION OF THE PREFERRED EMBODIMENTS

Figure 1:
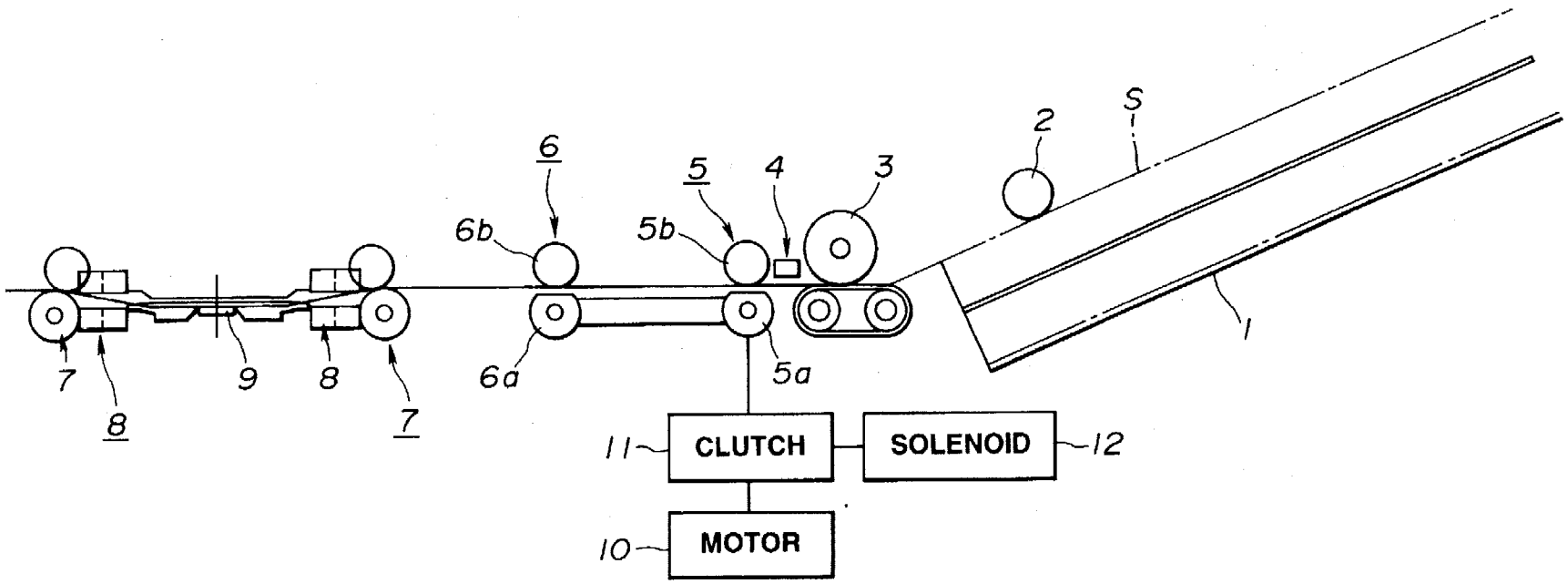
FIG. 1 is a schematic diagram illustrating the configuration of a reading device including a sheet feeding device according to a first embodiment of the present invention.

A description will now be provided of a sheet feeding device using the above-described means with reference to the drawings. FIG. 1 is a schematic diagram illustrating the configuration of a reading device including a sheet feeding device according to a first embodiment of the present invention.

First, a description will be provided of the schematic configuration of the reading device including the sheet feeding device with reference to FIG. 1. In FIG. 1, reference numeral 1 represents a sheet mounting unit, such as a cassette or the like, for mounting sheets of originals S (hereinafter termed "sheets"), such as sheets of ordinary paper, plastic sheets or the like. A pickup roller 2 is disposed above the sheet mounting unit 1. The pickup roller 2 contacts the uppermost sheet S mounted on the sheet mounting unit 1 and feeds the sheets S to a downstream side. A sheet separation/feeding unit 3 individually separates the sheets S by means of a cylindrical roller and a belt roller rotating in the same direction and feeds the separated sheet S. A sheet detection sensor 4, serving as sheet-edge detection means, detects the passage of the leading edge of the sheet S.

Pairs of feeding rollers 5 and 8, serving as feeding means, include rollers having a semispherical cross section (hereinafter termed "semispherical rollers") 5*a* and 6*a* at the driving side, and driven rollers 5*b* and 6*b* at the driven side, respectively. The semispherical rollers 5*a* and 6*a* and connected to each other by a belt so as to rotate in synchronization with each other. When cut surfaces of the semispherical rollers 5*a* and 6*a* face the driven rollers 5*b* and 6*b*, the sheet S is not held by the feed rollers respectively. In another state, the sheet S is held and fed by the circular surfaces of the semispherical rollers 5*a* and 6*a* together with the driven rollers 5*b* and 6*b*.

A pair of active registration rollers 7, serving as registration means, (comprising left and right pairs of rollers) correct skew of the sheet S fed by the feeding means by changing (accelerating or decelerating) the feeding speed of at least one of left and right pairs of rollers by changing the revolution speed thereof. Two skew-amount detection sensors 8, serving as skew-amount detection means, are disposed in a line in a direction orthogonal to the sheet feeding direction. The inclination of the leading edge of the sheet S is detected based on a time difference between signals obtained from the sensors 8 when the leading edge of the sheet S crosses the respective sensors 8. For example, transmission-type photosensors are used as the skew-amount detection sensors 8. The passage of the leading edge of the sheet S is detected when the optical path of the photosensors 8 is interrupted by the sheet S. Skew of the sheet S is corrected while the sheet S is fed to a reading unit 9 by controlling the feeding speeds of respective pairs of left and right active registration rollers 7 based on signals from the skew-amount detection sensors 8. The pair of active registration rollers 7 and the skew-amount detection sensors 8 are each disposed at both of two sides of the reading unit 9 in order to correct skew of the sheet S at a reading position.

Figure 6A:
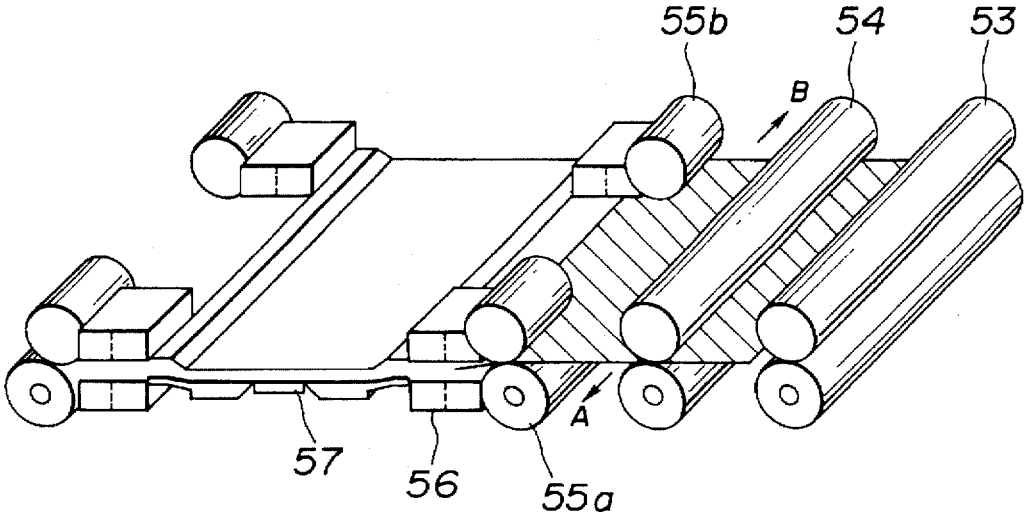
FIGS. 6(*a*) and 6(*b*) are diagrams illustrating the operations of active registration rollers when a sheet is held and not held by feeding rollers, respectively, in a conventional sheet feeding device.
Figure 6B:
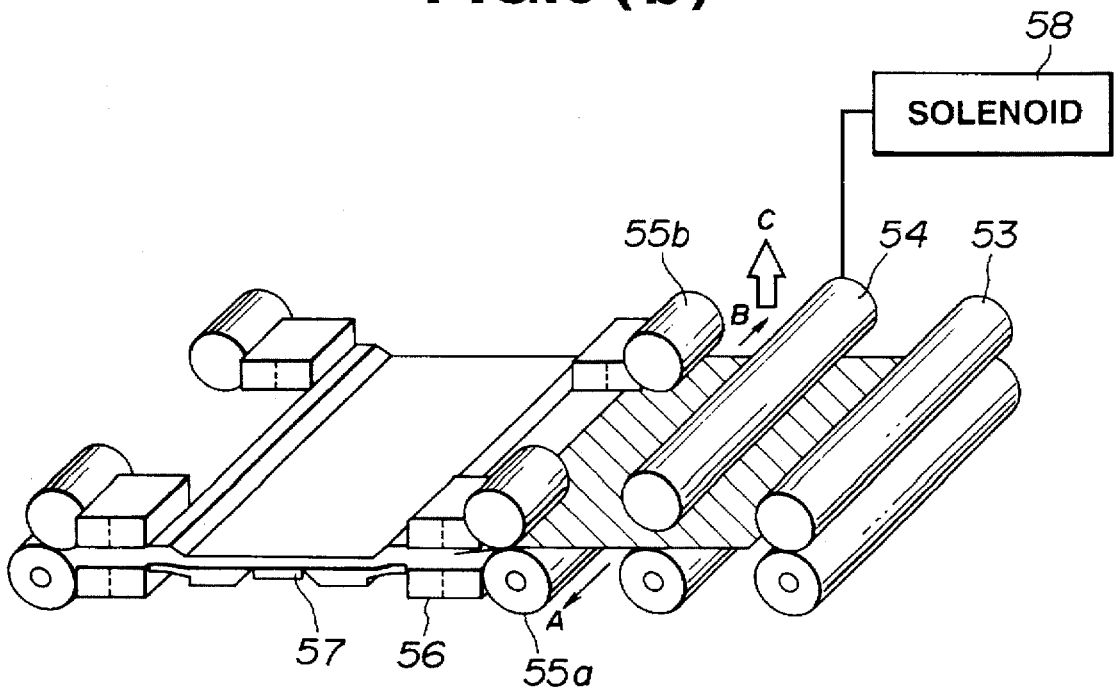

The pair of active registration rollers 7 are the same as in the conventional device described with reference to FIGS. 6(*a*) and 6(*b*), and comprise two pairs of rollers. The two pairs of rollers are arranged in a direction orthogonal S to the conveying direction of the sheet S at both ends of the conveying path. Each pair of rollers convey the sheet S while grasping a portion in the vicinity of each side of the sheet S, and are driven independently by a pulse motor.

The skew-amount detection sensors 8 calculate the amount of skew of the sheet S based on a time difference in detection of the sheet S by the respective sensors. For example, when a right corner portion of the leading edge of the sheet S is conveyed in a state of leading a left corner portion of the leading edge of the sheet S, the right sensor first detects the sheet S, and then the left sensor detects the sheet S. The amount of skew of the sheet S increases as the value of the time difference increases.

After calculating the amour of skew by control means or the like based on the time difference in sheet detection by the left and right sensors, the pair of active registration rollers 7 are controlled so as to correct the skew. For example, when the right corner portion of the leading edge of the sheet S is conveyed in a state of leading the left corner portion of the leading edge of the sheet S, the pair of active registration rollers 7 are controlled so that the right and left corner portions are arranged in the line in a direction orthogonal to the feeding direction. For that purpose, the conveying speed of the left pair of rollers is temporarily accelerated so that the left corner portion is arranged in the same line as the right corner portion, and is then returned to the original speed. Alternatively, the conveying speed of the right pair of rollers may be temporarily decelerated so as to retard the right corner portion, and then may be returned to the original speed. In another approach, the acceleration of the left pair of rollers and the deceleration of the right pair of rollers may be simuntaneously effected.

Similarly, when the left corner portion is conveyed in a state of leading the right corner portion, the right pair of rollers are accelerated, or the left pair of rollers are decelerated, or the acceleration of the right pair of rollers and the deceleration of the left pair of rollers are simultaneously effected.

The degree and the time period of acceleration or deceleration of each pair of rollers are calculated by the control means so as to correct skew of the sheet S in accordance with the amount of the skew.

The reading unit 9 is configured such that reflected light obtained by projecting light onto the sheet S fed onto platen glass is imaged onto a photoelectric transducer, such as a CCD (charge-coupled device) or the like, using a short-focus imaging lens or the like, and obtained image information is electrically encoded and stored in a memory.

In order to effectively utilize the pair of active registration rollers 7, it is necessary to stop the semispherical rollers 5*a* and 6*a*, capable of holding the sheet S in a state of not holding the sheet S, so that the sheet S is held by only the pair of active registration rollers 7 when correcting skew. For that purpose, it is necessary to determine the number of revolutions of the semispherical rollers 5*a* and 6*a* after which they must be stopped, after the sheet S has been fed to the semispherical roller 5*a*. When the sheet detection sensor 4 has detected the leading edge of the sheet S which has been separated and fed from the sheet separation/feeding unit 3, the semispherical rollers 5*a* and 6*a* start to rotate so as to be driven in the same positional relationship from the leading edge of the sheet S, and to be always situated at the same position from the leading edge of the sheet S. After rotating by the number of revolutions so as to be able to feed the sheet S to the pair of active registration rollers 7, the semispherical rollers 5*a* and 6*a* stop at positions where the cut surfaces of the semispherical rollers 5*a* and 6*a* face the driven rollers 5*b* and 6*b*, respectively, i.e., in a state of not holding the sheet S.

The semispherical rollers 5*a* and 6*a* are held at the same phase via the belt, and are driven by a motor 10 via a one-revolution control spring clutch 11. By rotating the spring clutch 11 by a necessary number of revolutions using a solenoid 12 after detecting a signal from the sheet detection sensor 4, the sheet S is fed from the semispherical rollers 5*a* and 6*a* to the pair of active registration rollers 7.

The semispherical rollers 5*a* and 6*a* are rotated by a number of revolutions obtained by adding a correction coefficient to a number obtained by dividing the length of the sheet feeding path by the length of sheet feeding by the semispherical rollers 5*a* and 6*a*. However, since the spring clutch 11 performs one-revolution control, the length of the sheet feeding path and the length of sheet feeding by the semispherical rollers 5*a* and 6*a* are determined so that the number of revolutions equals an integer.

According to the above-described configuration, by providing a state in which the trailing edge of the sheet S is not held by the pairs of feeding rollers 5 and 6 when the sheet S is fed to the pair of active registration rollers 7 by controlling the number of revolutions of the semispherical rollers 5*a* and 6*a* based on a detection signal of the leading edge of the sheet S from the sheet detection sensor 4, the trailing edge of the sheet S is not constrained by the pairs of feeding rollers 5 and 6 when the pair of active registration rollers 7 correct skew of the sheet S. Hence, it is possible to continuously feed sheets with a minimum interval while maintaining high accuracy in skew correction even if the sheet feeding speed is high and the intersheet interval is small.

In the first embodiment, a control circuit comprising a CPU, or the like, may be employed to effect the processing discussed above, In particular, the control circuit receives input signals, e.g., from each of the various above-described sensors, including sensors 4 and 8, and process these signals. The control circuit then drives each of the various driven components, e.g., solenoid 12, rollers 2, 3, and 7, and the like, to effect the above-discussed processing. The control circuit is schematically represented by reference numeral 1001 in FIG. 1.

Figure 2:
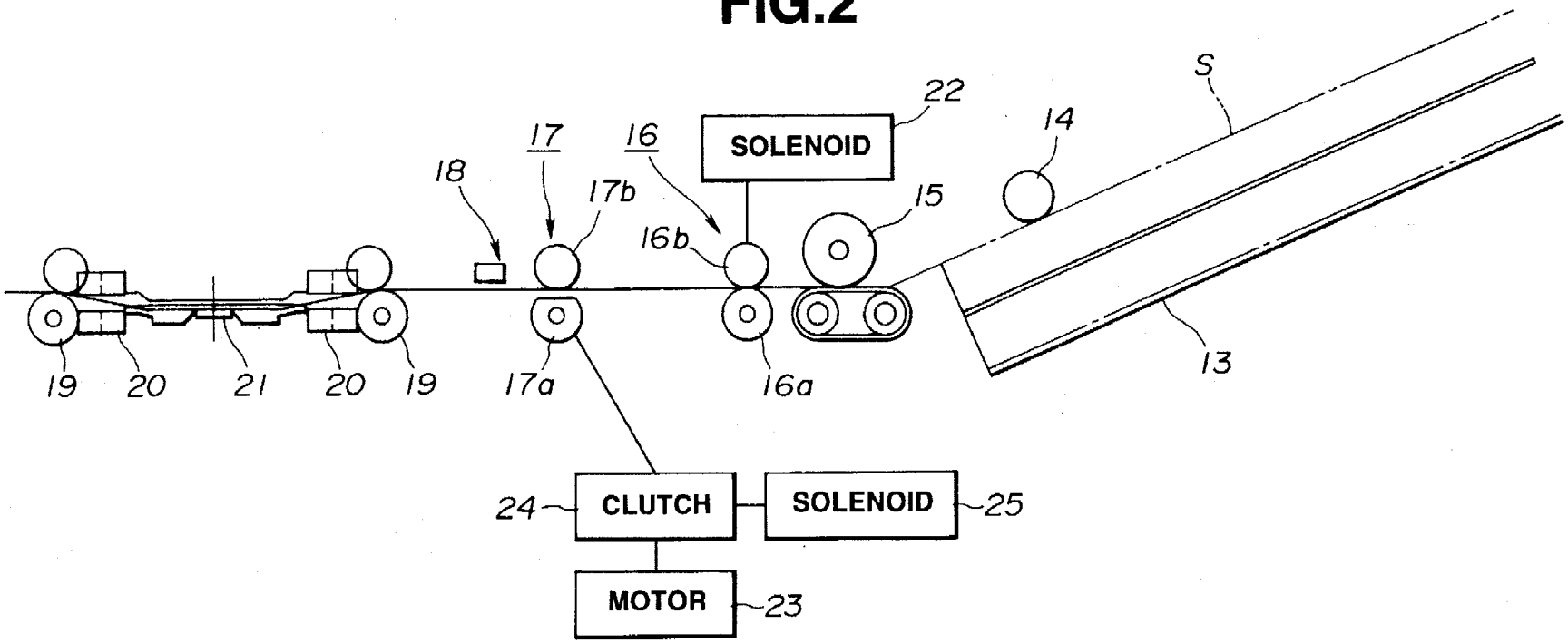
FIG. 2 is a schematic diagram illustrating the configuration of a reading device including a sheet feeding device according to a second embodiment of the present invention.

Next, a description will be provided of a sheet feeding device according to a second embodiment of the present invention with reference to FIG. 2. In FIG. 2, reference numeral 13 represents a sheet mounting unit, such as a cassette or the like, for mounting sheets of originals S (hereinafter termed "sheets"), such as sheets of ordinary paper, plastic sheets or the like. A pickup roller 14 is disposed above the sheet mounting unit 13. The pickup roller 14 contacts the uppermost sheet S mounted on the sheet mounting unit 13 and feeds the sheets S to a downstream side. A sheet separation/feeding unit 15 individually separates the sheets S by means of a roller and a belt roller rotating in the same direction and feeds the separated sheet S.

Pairs of feeding rollers 16 and 17 serve as first and second feeding means, respectively. The pair of feeding rollers 16 comprises a pair of cylindrical rollers 16*a* and 16*b*, whose driven roller 16*b* is configured so as to be pressable/detachable relative to a driving roller 16*a* by the drive of a solenoid 22. The pair of feeding rollers 17 which are disposed closer to the registration means (embodied as rollers 19) include a roller having a semispherical cross section (hereinafter termed a "semispherical roller") 17*a* at the driving side, and a driven roller 17*b* at the driven side. When a cut surface of the semispherical roller 17*a* faces the driven roller 17*b*, the sheet S is not held by the pair of feed rollers 17. In another state, the sheet S is held and fed by the circular surface of the semispherical roller 17*a* together with the driven roller 17*b*. The semispherical roller 17a is configured so as to be driven by a motor 23 via a one-revolution control spring clutch 24.

A sheet detection sensor 18 serves as sheet-edge detection means, and detects the passage of the leading edge of the sheet S. When the leading edge of the sheet S is detected by the sheet detection sensor 18, the sheet S is fed from the semispherical roller 17*a* to the registration means by performing one-revolution control of the spring clutch 24 by a solenoid 25.

A pair of active registration rollers 19, serving as registration means, (comprising left and right pairs of rollers) correct skew of the sheet S fed by the feeding means by changing the feeding speed of left and right pairs of rollers. Two skew-amount detection sensors 20, serving as skew-amount detection means, are disposed in a line in a direction orthogonal to the sheet feeding direction. The inclination of the leading edge of the sheet S is detected based on a time difference between signals obtained from the sensors 20 when the leading edge of the sheet S crosses the respective sensors 20. For example, transmission-type photosensors are used as the skew-amount detection sensors 20. The passage of the leading edge of the sheet S is detected when the optical path of the photosensors 20 is interrupted by the sheet S. Skew of the sheet S is corrected while the sheet S is fed to a reading unit 21 by controlling the feeding speeds of respective pairs of left and right active registration rollers 19 based on signals from the skew-amount detection sensors 20. The pair of active registration rollers 19 and the skew-amount detection sensors 20 are each disposed at both of two sides of the reading unit 21 in order to correct skew of the sheet S at a reading position.

As in the control of the pair of active registration rollers 7 described in the first embodiment, control means performs speed control of the left and right pairs of active registration rollers 19 in order to correct skew of the sheet S.

The reading unit 21 is configured such that reflected light obtained by projecting light onto the sheet S fed onto platen glass is imaged onto a photoelectric transducer, such as a CCD or the like, using a short-focus imaging lens or the like, and obtained image information is electrically encoded and stored in a memory.

The sheets S mounted on the sheet mounting unit 13 are fed to the sheet separation/feeding unit 15 by the pickup roller 14, and only the uppermost sheet S is separated and fed. The separated sheet S is fed to the pair of feeding rollers 17 by the pair of feeding rollers 16. When the leading edge of the sheet S has been detected by the sheet detection sensor 18, the sheet S is fed to the pair of active registration rollers 19 by one-revolution control of the semispherical roller 17*a*. At that time, the driven roller 16*b* of the pair of feeding rollers 16 provided at the upstream side is separated from the driving roller 16*a* by the solenoid 22, and assists feeding of the sheet S by the semispherical roller 17*a* and the driving roller 16*a*.

When the sheet S has been held by the pair of active registration rollers 19, the drive of the semispherical roller 17*a* is stopped, and the sheet S is fed by only the pair of active registration rollers 19. In this state, the sheet S is neither held by feeding rollers 16 nor feeding rollers 17. Rather, as discussed above, (1) the driven roller **16*b* has been moved away from the driving roller 16*a* by the solenoid 22, and (2) the semispherical roller 17*a* has been driven to rotate so that the cut surface of the semispherical roller 17*a* faces the driven roller 17*b* whereby the sheet S is not held by the feeding roller 17. When the amount of skew of the sheet S has been detected by the skew-amount detection sensors 20, the skew is corrected by the pair of active registration rollers 19 while the sheet S is fed to the reading unit 21**. This operation will now be described in detail.

When the leading edge of the sheet S fed to the pair of feeding rollers 17 has been detected by sheet detection sensor 18, the semispherical roller **17*a* starts to perform one revolution, and the sheet S is held by the pair of feeding rollers 17. Since the time required for this operation is always constant and is therefore predictable, the pressure of the pair of feeding rollers 16 is released after the lapse of the time period from the detection of the leading edge of the sheet S by the sheet detection sensor 18 until the sheet S is assuredly held by the pair of feeding rollers 17. The semispherical roller 17*a* is configured so as to be driven by a motor 23 via a one-revolution control spring clutch 24. The sheet S is fed to the pair of active registration rollers 19 by performing one-revolution control of the spring clutch 24 by the solenoid 25 after detecting a signal from the sheet detection sensor 18**.

According to the above-described configuration, since a state in which the sheet S is held by only the pair of active registration rollers 19 is maintained, skew correction can be effectively performed. This is because the pressure of the pair of feeding rollers 18 can be released before the sheet S is held by the pair of feeding rollers 17, and it is therefore possible to cover a delay in the response of the electric component. According to this configuration, the drive of the semispherical roller **17*a* can be controlled irrespective of variations in the sheet feeding time period, even if the sheet feeding path from the sheet feeding unit to the pair of active registration rollers 19** is long.

In a configuration in which skew correction can be performed both in sheet feeding from a cassette and in manual sheet feeding, for example, in manual sheet feeding, since various kinds of sheets having various thickness values must be fed, the sheet feeding time period has great variations. Accordingly, by performing feeding of the sheet S from the pair of feeding rollers 16 to the pair of feeding rollers 17 at a lower speed or while stopping the feeding only in manual sheet feeding, release of constraint of the trailing edge of the sheet S while the sheet S is driven by the pair of active registration rollers 19 can be assuredly effected. Furthermore, it is possible to adopt a sequence which can effectively utilize the pair of active registration rollers 19 for variations in feedability of the sheet S produced when feeding the sheet S from the pair of feeding rollers 16 to the semispherical roller **17*a*** in manual sheet feeding.

In the second embodiment, a control circuit, comprising a CPU or the like, may be employed to effect the processing discussed above. In particular, the control circuit receives input signals, e.g., from each of the various above-described sensors, including sensors 18 and 20, and process these signals. The control circuit then drives each of the various driven components, e.g., solenoids 22 and 25, rollers 15, 16, and 19, and the like, to effect the above-described processing. The control circuit is schematically represented by reference numeral 1002 in FIG. 2.

Although in the foregoing embodiments, a description has been provided of a reading device having a sheet feeding device, the invention is not limited to such a device. For example, the present invention may be applied to a recording device for forming an image on a sheet, or to an image forming aparatus including a reading device and a recording device.

As described above, according to the present invention, by providing a plurality of semispherical rollers at the driving side of feeding means disposed at a side upstream from registration means in the sheet feeding direction, when the leading edge of a sheet has been detected by sheet-edge detection means, the semispherical rollers are stopped in a state of not holding the sheet, after feeding the sheet to the registration means by rotating the semispherical rollers by a predetermined number of revolutions at the same phase, so that the trailing edge of the sheet is not constrained by the feeding means. It is thereby possible to continuously feed sheets with a minimum interval while maintaining high accuracy in skew correction, even if the sheet feeding speed is high and the intersheet interval is small.

In a configuration in which skew correction can be performed both in sheet feeding from a cassette and in manual sheet feeding, in manual sheet feeding, by performing feeding of a sheet from first feeding means to second feeding means including a semispherical roller at a lower speed or while stopping the feeding at a side upstream from the registration means only in manual sheet feeding, release of constraint of the trailing edge of the sheet during skew correction can be assuredly effected.

Next, a description will be provided of a third embodiment of the present invention with reference to the drawings.

Figure 3A:
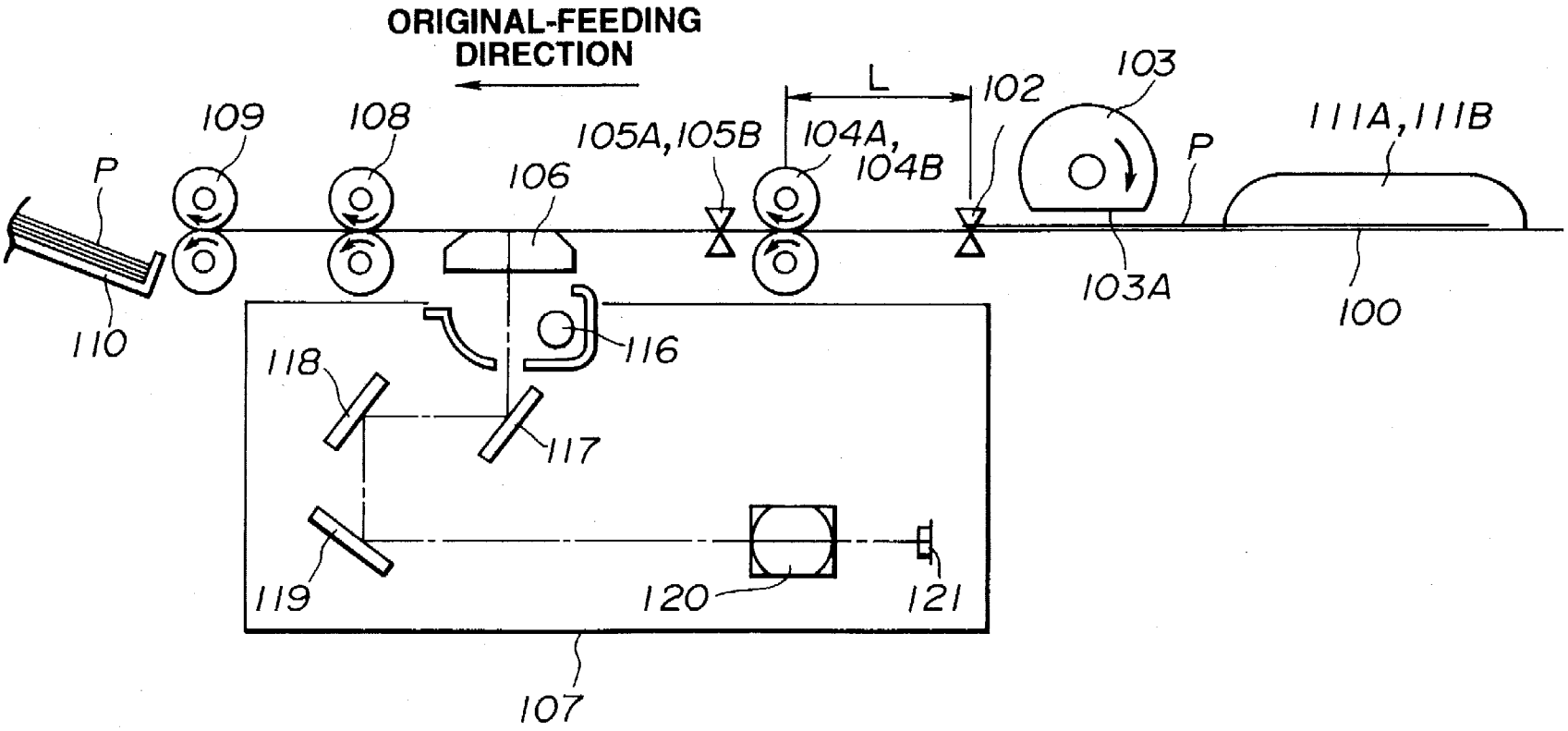
FIG. 3(*a*) is a vertical cross-sectional side view illustrating the entire configuration of an image reading device (a sheet processing device) according to a third embodiment of the present invention.
Figure 3B:
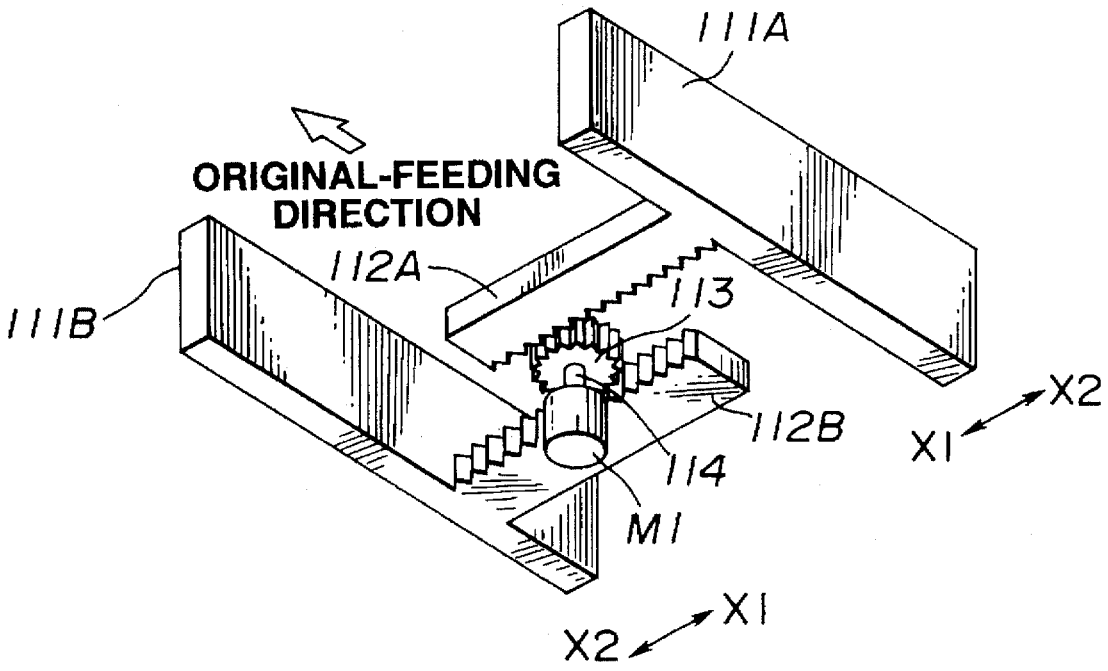
Figure 4:
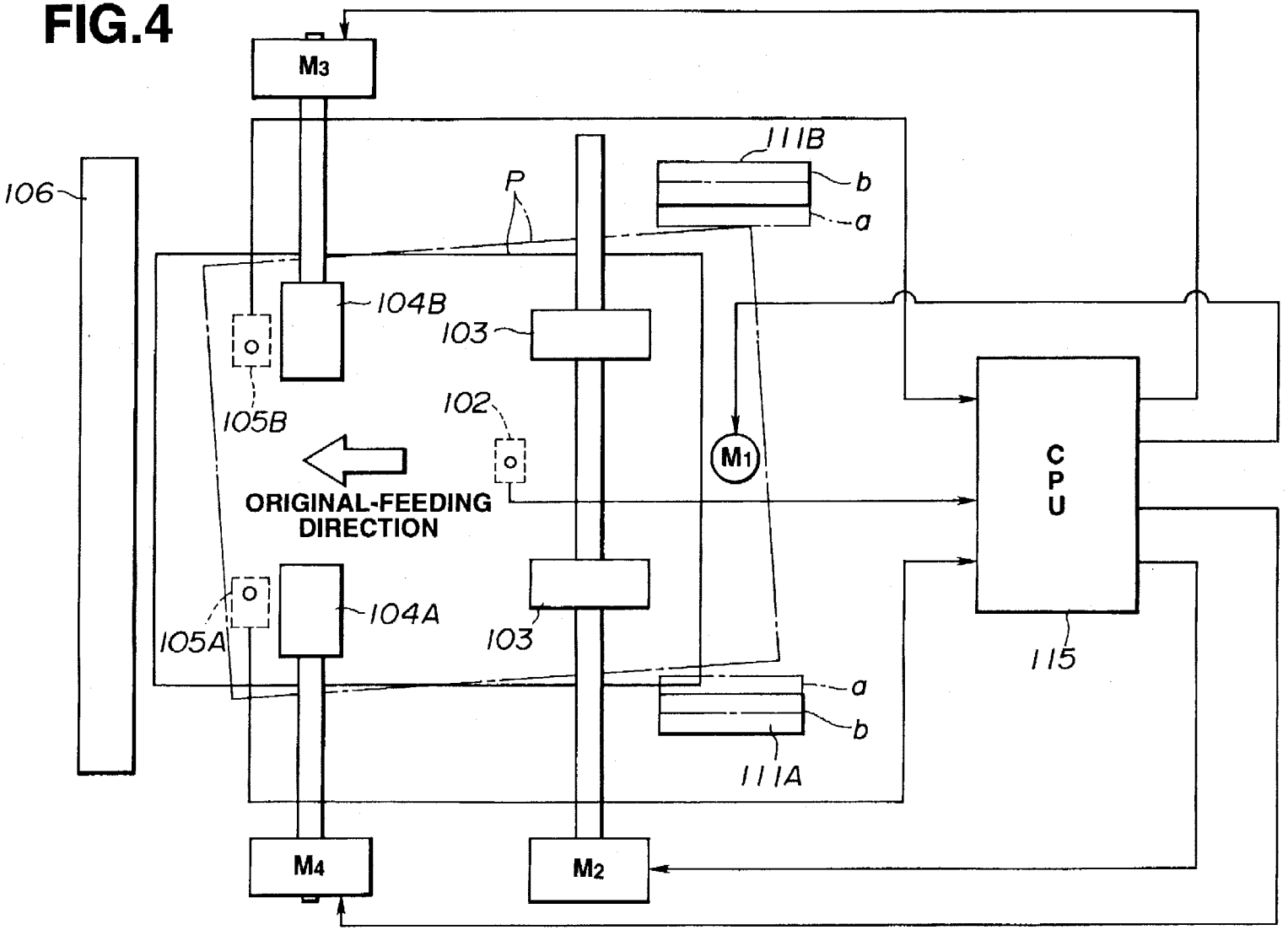
FIG. 4 is a plan view illustrating the configuration of a principal portion (inventive portion) of the image reading device.
Figure 5:
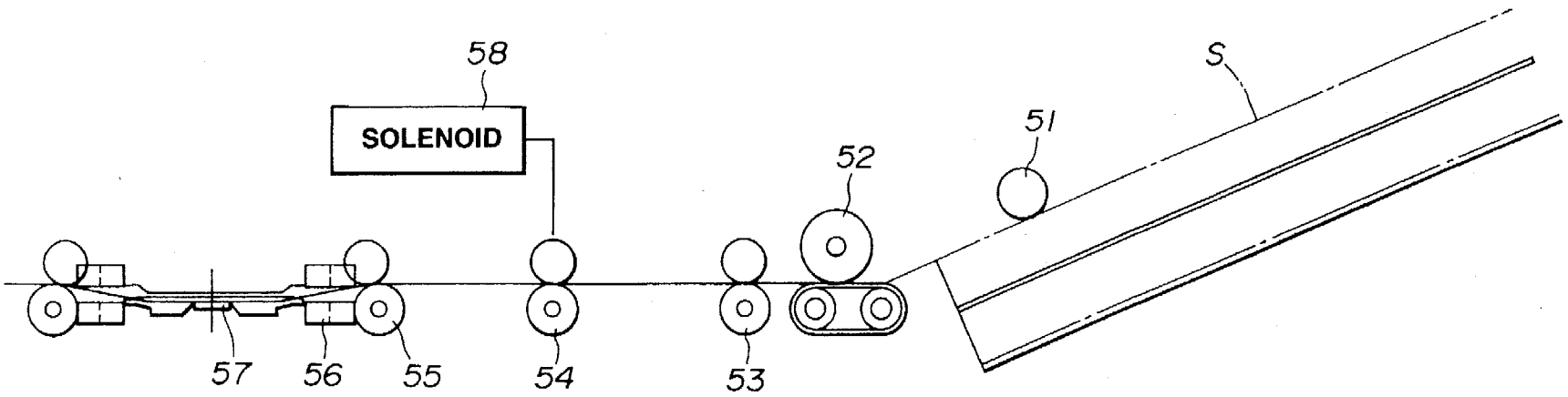
FIG. 5 is a diagram illustrating the configuration of a conventional image reading device.

FIG. 3(*a*) illustrates the entire configuration of an image reading device (i.e., a sheet processing device) according to the third embodiment. FIG. 4 illustrates the configuration of a principal portion (inventive portion) of the image reading device shown in FIG. 3(*a*).

First, a description will be provided of the entire configuration of the image reading device by illustrating the flow of an original P.

The original P to be fed is mounted on a sheet feeding tray (sheet mounting means) 100 by the operator, and is fed until the leading edge of the original P is detected by an original-detection sensor (reflection-type photoelectric sensor) 102. When the original P has been mounted on the sheet feeding tray 100 in the above-described manner, a semispherical sheet feeding roller 103 starts to rotate in a clockwise direction in response to a detection signal from the original-detection sensor 10Z to feed the original P mounted on the sheet feeding tray 100.

The original P fed by the sheet feeding roller 103 is then fed by pairs of left and right registration rollers (skew correction means of the active registration method) 104A and 104B onto transparent glass 106 for reading an image on the original P.

At that time, when there is a time difference between the detection of the leading edge of the original P by left and right registration detection sensors (transmission-type sensors) 105A and 105B for detecting the leading edge of the original P passing through the pairs of left and right registration rollers 104A and 104B, the feeding speed of one of the pairs of left and right registration rollers 104A and 104B is changed in order to correct a skewed state of the original P so that the original P passes through the surface of the transparent glass 106 in a correct posture.

While passing through the surface of the transparent glass 106, an image formed on the lower surface of the original P is sequentially read by an image reading unit (scanner unit) 107.

The original P whose image has been read while passing through the surface of the transparent glass 106 is fed by a pair of feeding rollers 108, and is discharged and mounted onto a sheet discharging tray 110 by a pair of sheet discharging rollers 109.

Left-side and right-side regulating members 111A and 111B configured as shown in FIG. 3(*b*) are provided on the sheet feeding tray 100. Rack units 112A and 112B protruding in a direction orthogonal to the original-feeding direction are provided inside the left-side and right-side regulating members 111A and 111B, respectively, and the left-side and right-side regulating members 111A and 111B are connected via a pinion gear 113 meshing with the rack units 112A and 112B. The pinion gear 113 is mounted on an output shaft 114 of a stepping motor (driving means) M1.

When the pinion gear 113 is rotated in a counterclockwise direction, the left-side and right-side regulating members 111A and 111B move in directions indicated by arrows X1. When the pinion gear 113 is rotated in a clockwise direction, the left-side and right-side regulating members 111A and 111B move in directions indicated by arrows X2.

The left-side and right-side regulating members 111A and 111B are set in advance by the operator at positions corresponding to the size of the original P before mounting the originals P on the sheet feeding tray 100. In FIG. 4, positions "a" indicated by imaginary lines represent positions set in accordance with the size of the original P. In this case, if one of the left-side and right-side regulating members 111A and 111B is moved in the direction indicated by the arrow X1 or X2, the other member also moves by the same distance in the opposite direction by the function of an interlocking mechanism comprising the rack units 112A and 112B and the pinion gear 113.

The stepping motor M1 is controlled by a CPU (control means) 115 for controlling the operation of the entire image reading device.

The semispherical sheet feeding roller 103 stops rotation in a state in which its cut portion 103A faces downward. When a detection signal from the original-detection sensor 102 has entered the CPU 115, the semispherical sheet feeding roller 103 performs one revolution in a clockwise direction from this state and then stops rotating. The sheet feeding roller 108 is driven by a motor M2 controlled by the CPU 115.

Respective pairs of left and right registration rollers 104A and 104B are provided in the same line as each other orthogonal to the original-feeding direction. In this case, the pairs of left and right registration rollers 104A and 104B are disposed so as to be situated at two side portions of an original having the minimum width which can be fed by the image reading device. The distance L between the pairs of left and right registration rollers 104A and 104B and the original-detection sensor 102 is set to be smaller than the feeding distance of the original P by one revolution of the sheet feeding roller 103.

The pairs of left and right registration rollers 104A and 104B are rotatably driven independently by motors M4 and M3 controlled by the CPU 115, respectively. Usually, the CPU 115 controls the driving of the motors M4 and M3 so that the pairs of left and right registration rollers 104A and 104B have the same feeding speed. At that time, the feeding speed of the pairs of left and right registration rollers 104A and 104B is the same as the feeding speed of the sheet feeding roller 103.

The left and right registration detection sensors 105A and 105B are provided in the same line as each other in a direction orthogonal to the original-feeding direction. In this case, the left and right registration detection sensors 105A and 105B are disposed at positions facing the pairs of left and right registration rollers 104A and 104B, respectively.

The image reading unit 107 includes an illuminating lamp 116 for illuminating the lower surface (image surface) of the original P passing through the surface of the transparent glass 106 from below the transparent glass 106, first, second and third mirrors 117, 118 and 119 for reflecting the optical image of the original P entering through the transparent glass 106 in predetermined directions, a condensor lens 120 for condensing the optical image reflected by the third mirror 119, a CCD element 121 for reading the optical image condensed by the condensor lens 120, and the like.

Next, a description will be provided of operations when correcting skew with reference to FIG. 4.

When skew is not produced in the fed original P as indicated by solid lines, left and right portions of the leading edge of the original P passing through the pair of left and right registration rollers 104A and 104B are detected substantially simultaneously by the left and right registration detection sensors 105A and 105B. That is, detection signals from the left and right registration detection sensors 105A and 105B are substantially simultaneously input to the CPU 115.

In this case, the CPU 115 drives the pairs of left and right registration rollers 104A and 104B without changing the feeding speed.

When skew is produced in the fed original P as indicated by imaginary lines, left and right portions (e.g., corners) of the leading edge of the original P passing through the pairs of left and right registration rollers 104A and 104B are not simultaneously detected by the left and right registration detection sensors 105A and 105B, respectively, and a time difference (time lag) is produced in the detection by the left and right registration detection sensors 105A and 105B. That is, detection signals from the left and right registration detection sensors 105A and 105B are input to the CPU 115 with the time difference. When a right portion of the leading edge of the original P fed by the pair of right registration rollers 104B leads a left portion of the leading edge of the original P as shown in FIG. 4, a detection signal from the right registration detection sensor 105B is input to the CPU 115 earlier than a detection signal from the left registration detection sensor 4A.

In this case, the CPU 115 corrects the skewed state of the original P by changing the feeding speed of one of the pairs of left and right registration rollers 104A and 104B. In the present embodiment, in this case, the driving of the motor M4 is therefore controlled so as to increase the feeding speed of the pair of left registration rollers 105A.

The CPU 115 calculates the amount of inclination of the leading edge of the original P based on the time difference between the detection signals from the left and right registration detection sensors 105A and 105B, and in this case controls the driving of the motor M4 based on the calculated amount of inclination. If, instead, for example, a left portion of the leading edge of the original P fed by the pair of left registration rollers 104A leads a right portion of the leading edge of the original P, then the CPU 115 may instead control the motor M3 to increase the speed of right registration roller 104B (relative to the speed of left registration roller 104A) in accordance with an amount of inclination calculated from sensors 105A and 105B in the manner described above. Whichever portion of the original P is leading, the revolution speed of the registration rollers are controlled so that the revolution speed of the registration roller closer to a trailing one of two corner portions of the leading edge of the original P is made to be higher relative to the speed of the other registration roller. The active registration rollers described in the first and second embodiments also correct the skew by performing a similar control.

When the pairs of left and right registration rollers 104A and 104B correct the skewed state of the original P, if the trailing edge of the original P is regulated by the left-side and right-side regulating members 111A and 111B, correction of the skew by the pairs of left and right registration rollers 104A and 104B cannot be performed with excellent accuracy.

That is, when the original P whose skew is to be corrected by the pairs of left and right registration rollers 104A and 104B rotates around the nip between the pair of right registration rollers 104B, if the trailing edge of the original P is regulated by the left-side and right-side regulating members 111A and 111B, the necessary rotation cannot be realized, so that slip is produced in the pair of left registration rollers 104A whose feeding speed has been increased. The active registration rollers described in the first and second embodiments effect skew correction by performing a similar control.

Accordingly, in the present image reading device, when the leading edge of the original P passing through the pairs of left and right registration rollers 104A and 104B has been detected by one of the left and right registration detection sensors 105A and 105B, the CPU 115 performs control so as to retract the left-side and right-side regulating members 111A and 111B from the position "a" for regulating the original P to a predetermined position "b" by driving the stepping motor M1.

Thus, the trailing edge of the original P whose skew is being corrected by the pairs of left and right registration rollers 104A and 104B is not regulated by the left-side and right-side regulating members 111A and 111B and is therefore in a freely rotatable state, so that slip is not produced in the pair of left registration rollers 104A.

When the trailing edge of the original P whose skew was corrected by the pairs of left and right registration rollers 104A and 104B has passed through the sheet feeding tray 100 and has been detected by the original-detection sensor 102, the CPU 115 performs a control so as to return the retracted left-side and right-side regulating members 111A and 111B to the original-regulating position "a".

Figure 7:
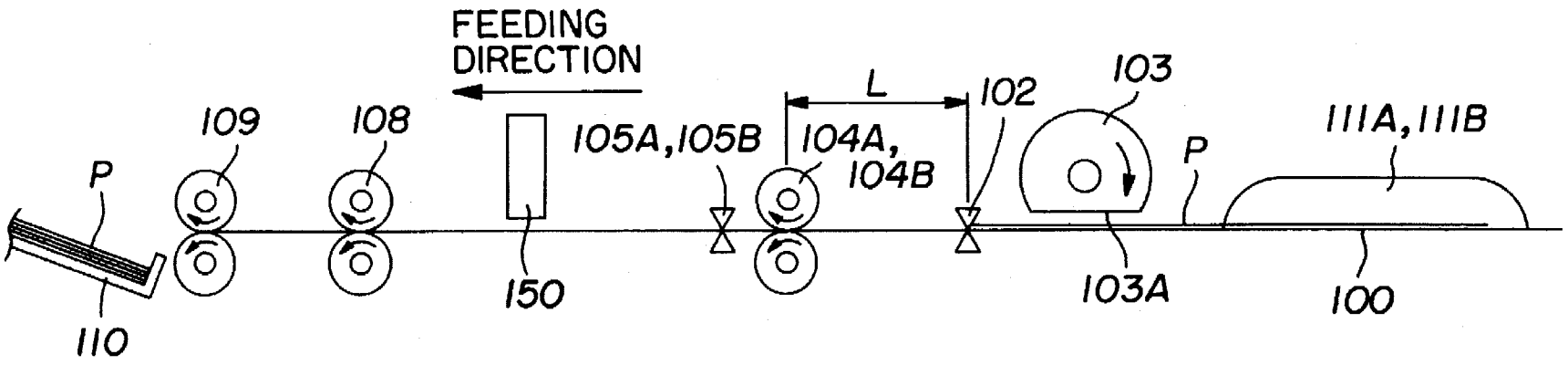
FIG. 7 is a vertical cross-sectional side view illustrating an embodiment with image forming means.

The present invention is not limited to the above-described image reading device, but may also be widely applied to any other sheet processing device used in an image forming apparatus comprising image forming means, such as a printer having an ink jet head, a facsimile apparatus, a copy machine having an image bearing drum or the like. FIG. 7 illustrates application of the invention to a printer with ink jet head 150.

Although in the above-described embodiments, skew correction of the original P is performed using skew correction means of the active registration method, the present invention may, of course, be applied to a case in which skew correction of the original P is performed using skew correction means of the loop registration method or the shutter registration method.

Figure 8:
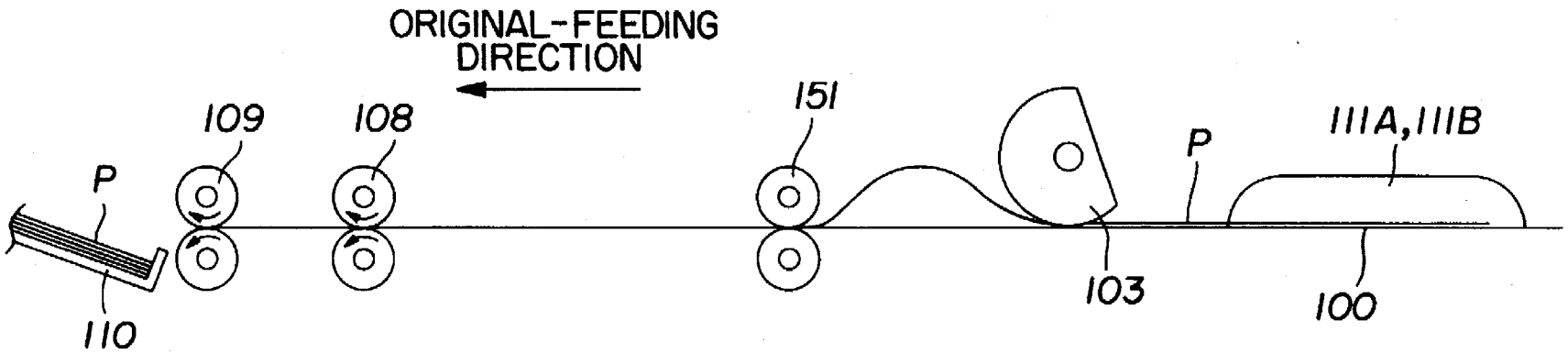
FIG. 8 is a vertical cross-sectional side view illustrating an embodiment with skew correction means.

In the loop registration method, which is illustrated in FIG. 8, the skew is corrected by bending the sheet by pressing the leading edge of the sheet against a nip between a pair of rollers 151 which are stopped.

Figure 9:
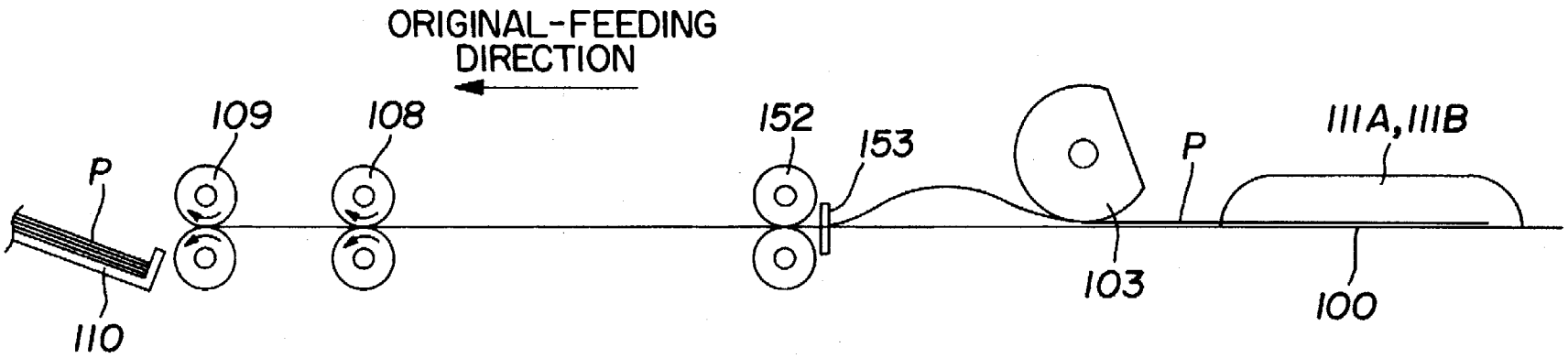
FIG. 9 is a vertical cross-sectional side view of the embodiment of FIG. 8 where the skew correction means comprises a registration shutter.

In the shutter registration method, which is illustrated in FIG. 9 the skew is corrected by bending the sheet by pressing the leading edge of the sheet against a registration shutter which is protrudable in a sheet feeding path. In FIG. 9 the reference numeral 153 corresponds to a registration shutter. The reference numeral 152 is a pair of transportation rollers. The skew of a sheet is corrected by the registration shutter 153, and the sheet is held and transported by the pair of transportation rollers 152 at the time of the retraction of the registration shutter 153.

As described above, in the sheet processing device of the present invention, sheet regulating means on sheet mounting means is retracted from sheet regulating positions to predetermined positions when starting correction of a skewed state of a fed sheet by skew correction means. Accordingly, even if the trailing edge of the sheet having a long size in the feeding direction whose skew is being corrected by the skew correction means is on the sheet mounting means, the trailing edge of the sheet is not regulated by the sheet regulating means and is therefore in a freely rotatable state. Hence, skew correction of the sheet by the skew correction means can be performed with high accuracy.

The control of the active registration rollers is not limited to the approaches of the above-described embodiments. In short, skew of a sheet is corrected by advancing or retarding a trailing portion or a leading portion of the leading edge of the sheet, respectively, by increasing or decreasing the revolution speed of at least one of pairs of left and right rollers, or by simulaneously changing the feeding speeds of both portions of the leading edge of the sheet by changing the revolution speeds of the pairs of left and right rollers.

The individual components shown in outline or designated by blocks in the drawings are all well known in the sheet feeding device arts, and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet feeding device comprising:

skew-amount detection means for detecting an amount of skew of a sheet:

skew correction means for correcting the skew of the sheet;

at least one roller, disposed at a side upstream from said skew correction means so as to be adjacent thereto, and having a non-contact portion, which does not contact the sheet, at its circumferential surface, for feeding the sheet to said skew correction means; and control means for controlling said roller so that the noncontact portion of said roller faces the sheet while said skew correction means corrects the skew.

2. A device according to claim 1, wherein said roller has a semispherical cross section.

3. A device according to claim 1, wherein said control means comprises a clutch for stopping said roller when it has rotated to a position where the noncontact portion of said roller faces the sheet.

4. A device according to claim 1, further comprising feeding means, disposed at a side upstream from said roller, for feeding the sheet to said roller.

5. A device according to claim 4, further comprising separation means for separating said feeding means from the sheet after said roller has started to contact the sheet.

6. A device according to claim 4, wherein said control means comprises means for driving said roller with one-revolution control after driving of said feeding means has been decelerated or stopped.

7. A device according to claim 1, further comprising image forming means for forming an image on the sheet.

8. A device according to claim 1, further comprising image reading means for reading an image on the sheet.

9. A device according to claim 1, wherein said skew correction means comprises a plurality of feeding rotating members for providing a feeding force for the sheet, and wherein said control means comprises means for controlling a speed of at least one of said plurality of feeding rotating members so as to relatively change revolution speeds of said plurality of rotating members in order to correct the skew in accordance with the detection by said skew-amount detection means.

10. A device according to claim 9, wherein said plurality of feeding rotating members comprise first and second feeding rotating members arranged in a line in a direction orthogonal to a feeding direction of the sheet.

11. A device according to claim 10, wherein said control means comprises means for correcting the skew by controlling said plurality of feeding rotating members so that the revolution speed of one of said plurality of feeding rotating members closer to a leading one of two corner portions of the leading edge of the sheet is lower than the speed of the other feeding rotating members.

12. A device according to claim 10, wherein said control means comprises means for correcting the skew by controlling said plurality of feeding rotating members so that the revolution speed of one of said plurality of feeding rotating members closer to a trailing one of two corner portions of the leading edge of the sheet is higher than the speed of the other feeding rotating members.

13. A device according to claim 10, wherein each of said plurality of feeding rotating members comprises a pulse motor for driving each respective feeding rotating member.

14. A device according to claim 10, wherein said skew-amount detection means comprises a plurality of sheet sensors, arranged in a line in a direction orthogonal to the sheet feeding direction, for detecting the sheet.

15. A device according to claim 14, wherein said control means comprises means for calculating an amount of the skew of the sheet based on a time difference in the detection of the sheet by said plurality of sheet sensors.

16. A sheet feeding device comprising:

mounting means for mounting sheets;

regulating means for regulating positions of the sheets mounted on said mounting means in a lateral direction of the sheets, the lateral direction being orthogonal to a sheet feeding direction;

feeding means for feeding one of the sheets from said mounting means;

skew correction means for correcting skew of the sheet fed by said feeding means; and moving means for moving said regulating means so as to separate said regulating means from the sheet while said skew correction means corrects the skew of the sheet.

17. A device according to claim 16, further comprising image forming means for forming an image on the sheet whose skew has been corrected by said skew correction means.

18. A device according to claim 16, further comprising image reading means for reading an image on the sheet whose skew has been corrected by said skew correction means.

19. A device according to claim 16, wherein said skew correction means comprises (a) a pair of rollers, and (b) means for correcting the skew by bending the sheet by pressing the leading edge of the sheet against a nip between the pair of rollers which are stopped.

20. A device according to claim 16, wherein said skew correction means comprises (a) a registration shutter protrudable in a sheet feeding path, and (b) means for correcting the skew by bending the sheet by pressing the leading edge of the sheet against said registration shutter.

21. A device according to claim 16, further comprising (a) skew-amount detection means for detecting an amount of skew of the sheet, wherein said skew correction means comprises a plurality of feeding rotating members for providing a feeding force for the sheet, and (b) control means for controlling a speed of at least one of said plurality of feeding rotating members so as to relatively change revolution speeds of said plurality of rotating members in order to correct the skew in accordance with the detection by said skew-amount detection means.

22. A device according to claim 21, wherein said plurality of feeding rotating members comprise first and second feeding rotating members arranged in a line in a direction orthogonal to the feeding direction of the sheet.

23. A device according to claim 22, wherein said control means comprises means for correcting the skew by controlling said plurality of feeding rotating members so that the revolution speed of one of said plurality of feeding rotating members closer to a leading one of two corner portions of the leading edge of the sheet is lower than the speed of the other feeding rotating members.

24. A device according to claim 22, wherein said control means comprises means for correcting the skew by controlling said plurality of feeding rotating member so that the revolution speed of one of said plurality of feeding rotating members closer to a trailing one of two corner portions of the leading edge of the sheet is higher than the speed of the other feeding rotating members.

25. A device according to claim 22, wherein each of said plurality of feeding rotating members comprises a pulse motor for driving each respective feeding rotating member.

26. A device according to claim 22, wherein said skew-amount detection means comprises a plurality of sheet sensors, arranged in a line in a direction orthogonal to the sheet feeding direction, for detecting the sheet.

27. A device according to claim 26, wherein said control means comprises means for calculating an amount of the skew of the sheet based on a time difference in the detection of the sheet by said plurality of sheet sensors.

28. A sheet feeding device comprising:

skew correction means for correcting skew of a sheet, said skew correction means comprising a plurality of feeding rotating members for providing feeding force to the sheet;

at least one roller which is disposed at a side upstream from said skew correction means so as to be adjacent thereto, and having a noncontact portion with the sheet at its circumferential surface for feeding the sheet to said skew correction means; and control means for controlling a speed of at least one of said plurality of feeding rotating members so as to relatively change revolution speed of said plurality of feeding rotating members in order to correct the skew.

* * * * *

UNITED STATES PATENT AND TRADEMARK OFFICE

CERTIFICATE OF CORRECTION

PATENT NO. : 5,681,036
DATED : October 28, 1997
INVENTOR(S) : Shinichiro WAKAHARA, et al.

It is certified that error appears in the above-identified patent and that said Letters Patent is hereby corrected as shown below:

Column 3, line 44, after "fed", insert --by--.

Column 5, line 37, delete "and" (second occurrence) and insert therefor --are--;
Line 40, after "rollers", insert --5 and 6,--.

Column 6, line 4, delete "S";
Line 6, delete "convey" and insert therefor --conveys--;
Line 18, delete "amour" and insert therefor --amount--;
Line 36, delete "simuntaneously" and insert therefor --simultaneously--.

Column 7, line 42, delete "process" and insert therefor --processes--.

Column 9, line 33, delete "18" and insert therefor --16--.

Column 10, line 47, delete "10Z" and insert therefor --102--.

Column 14, line 26, delete "simulaneously" and insert therefor --simultaneously--.

Column 15, line 21, delete "comprise" and insert therefor --comprises--.

UNITED STATES PATENT AND TRADEMARK OFFICE

CERTIFICATE OF CORRECTION

PATENT NO. : 5,681,036
DATED : October 28, 1997
INVENTOR(S) : Shinichiro WAKAHARA, et al.

It is certified that error appears in the above-identified patent and that said Letters Patent is hereby corrected as shown below:

Column 16, line 23, delete "comprise" and insert therefor
--comprises--;
Line 35, delete "member" and insert therefor
--members--;
Line 45, delete "sheet,feeding" and insert therefor
--sheet feeding--.

Signed and Sealed this

Twenty-eighth Day of April, 1998

Bruce Lehman

*Attest:*

BRUCE LEHMAN

*Attesting Officer*

*Commissioner of Patents and Trademarks*